US010109267B2

(12) United States Patent
Harada

(10) Patent No.: US 10,109,267 B2
(45) Date of Patent: Oct. 23, 2018

(54) ELECTRONIC WIND INSTRUMENT

(71) Applicant: CASIO COMPUTER CO., LTD., Tokyo (JP)

(72) Inventor: Eiichi Harada, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 56 days.

(21) Appl. No.: 15/049,266

(22) Filed: Feb. 22, 2016

(65) Prior Publication Data

US 2016/0275930 A1 Sep. 22, 2016

(30) Foreign Application Priority Data

Mar. 19, 2015 (JP) ..... 2015-056018

(51) Int. Cl.
*G10H 1/32* (2006.01)
*G10H 1/46* (2006.01)
*G10H 1/055* (2006.01)

(52) U.S. Cl.
CPC ..... *G10H 1/32* (2013.01); *G10H 1/055* (2013.01); *G10H 1/46* (2013.01); *G10H 2220/361* (2013.01); *G10H 2230/205* (2013.01); *G10H 2230/221* (2013.01)

(58) Field of Classification Search
USPC ..... 84/615
See application file for complete search history.

(56) References Cited

U.S. PATENT DOCUMENTS 3,767,833 A * 10/1973 Noble ..... G10H 1/00 84/673
4,038,895 A * 8/1977 Clement ..... G10H 5/002 4/558
4,515,060 A * 5/1985 Ferron ..... G10D 9/00 84/380 R
5,140,888 A * 8/1992 Ito ..... G10H 1/055 84/723
6,476,310 B1 * 11/2002 Baum ..... C03B 37/01228 84/600
2005/0217464 A1 10/2005 Onozawa et al.

FOREIGN PATENT DOCUMENTS

JP H3-177897 A 8/1991
JP H4-24690 A 1/1992
JP H6-31515 Y2 8/1994
JP 2009-258750 A 11/2009

* cited by examiner

*Primary Examiner* — Christopher Uhlir
(74) *Attorney, Agent, or Firm* — Chen Yoshimura LLP

(57) ABSTRACT

An electronic wind instrument includes: a breath pressure detector that detects a breath pressure developed in the instrument by breath blown into the instrument and that outputs a signal corresponding to the detected breath pressure; an adjustment unit providing an air exhaust passage for the breath blown into the instrument, the air exhaust passage being configured to have a variable conductance for air so that a sensitivity of the breath pressure detector relative to an input pressure of the breath blown into the instrument varies; and a controller that sets one or more among a tone, a volume, and a pitch of a sound to be generated by a sound source in accordance with the signal outputted from the breath pressure detector.

9 Claims, 11 Drawing Sheets

ELECTRONIC WIND INSTRUMENT

BACKGROUND OF THE INVENTION

Technical Field

The present invention relates to an electronic musical instrument.

Background Art

Conventional electronic wind instruments that electronically synthesize and output musical notes are a well-known technology. Such electronic wind instruments typically include performance controls and a mouthpiece, and a breath pressure detector (a pressure sensor) is typically built into the mouthpiece. Notes are turned on and off and the volume is controlled according to the values detected by the breath pressure detector.

In acoustic wind instruments, musical notes are produced as air blown into the instrument exits through a sound-emitting portion (in acoustic wind instruments, the bell portion, for example). In contrast, in electronic wind instruments, musical notes are produced according to values detected by the breath pressure detector, and therefore the instrument does not have to be designed such that air blown into the instrument in order to produce musical notes exits the instrument.

Nonetheless, a structure (a drain) that allows the air to exit is still typically provided in order to better reproduce the feeling of playing an acoustic instrument (see Japanese Patent Application Laid-Open Publication No. 2009-258750, for example).

SUMMARY OF THE INVENTION

However, if the performer does not blow enough air into the instrument, it is difficult to make the resulting musical notes sufficiently loud.

The present invention, in at least one aspect, aims to provide an electronic wind instrument that makes it possible to easily control at least one of the volume, pitch, and tone of the musical notes while playing the instrument. Accordingly, the present invention is directed to a scheme that substantially obviates one or more of the above-discussed and other problems due to limitations and disadvantages of the related art.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic wind instrument, including: a breath pressure detector that detects a breath pressure developed in the instrument by breath blown into the instrument and that outputs a signal corresponding to the detected breath pressure; an adjustment unit providing an air exhaust passage for the breath blown into the instrument, the air exhaust passage being configured to have a variable conductance for air so that a sensitivity of the breath pressure detector relative to an input pressure of the breath blown into the instrument varies; and a controller that sets one or more among a tone, a volume, and a pitch of a sound to be generated by a sound source in accordance with the signal outputted from the breath pressure detector.

In another aspect, the present disclosure provides an electronic wind instrument, including: a breath pressure detector that detects a breath pressure developed in the instrument by breath blown into the instrument and that outputs a signal corresponding to the detected breath pressure; an adjustment unit having a variable conductance for air for the breath blown into the instrument so that a sensitivity of the breath pressure detector relative to an input pressure of the breath blown into the instrument varies; and a controller that sets one or more among a tone, a volume, and a pitch of a sound to be generated by a sound source in accordance with the signal outputted from the breath pressure detector.

It is to be understood that both the foregoing general description and the following detailed description are exemplary and explanatory, and are intended to provide further explanation of the invention as claimed.

DETAILED DESCRIPTION OF EMBODIMENTS

Figure 1A:
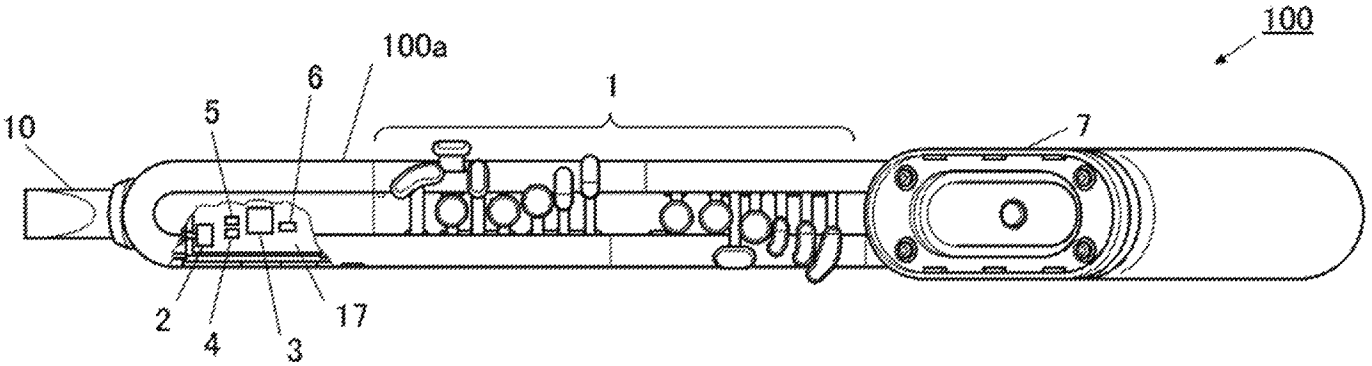
FIG. 1A is a plan view of an electronic wind instrument according to Embodiment 1 of the present invention.

Embodiments 1 to 3 of the present invention will be described in detail below with reference to the attached drawings. It should be noted that the present invention is not limited to the examples illustrated in the drawings.

Embodiment 1

Figure 1B:
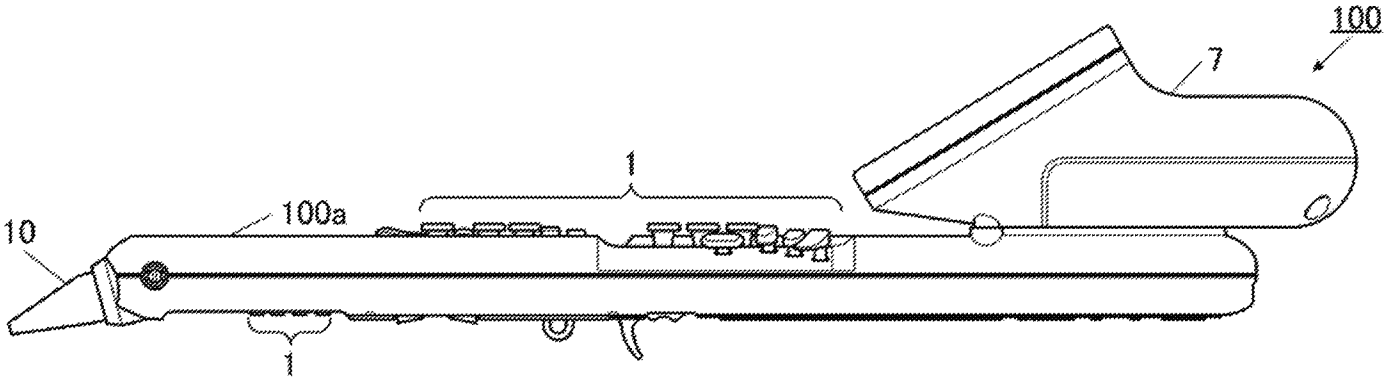
FIG. 1B is a side view of the electronic wind instrument according to Embodiment 1.

Next, an embodiment of the present invention will be described with reference to FIGS. 1A to 5. First, the device according to the present embodiment will be described with reference to FIGS. 1A and 1B. FIG. 1A is a plan view of an electronic wind instrument 100 according to the present embodiment. FIG. 1B is a side view of the electronic wind instrument 100.

The electronic wind instrument 100 according to the present embodiment makes it possible to utilize musical performance techniques typically used when playing an acoustic wind instrument. The present embodiment will be described with the electronic wind instrument 100 being a saxophone as an example. However, the present invention is not limited to this example, and the electronic wind instrument 100 may be an electronic version of another woodwind instrument such as a clarinet, a brass instrument, or any other type of wind instrument.

As illustrated in FIGS. 1A and 1B, the electronic wind instrument 100 according to the present embodiment includes a body 100*a*, controls 1 on the body 100*a*, a sound system 7, and a mouthpiece 10. The electronic wind instrument 100 is shaped like an acoustic saxophone.

The body 100*a* is shaped like the main body of a saxophone. The controls 1 include performance keys for controlling pitch and the like as well as various settings keys and are operated by the performer's (the user's) fingers. The mouthpiece 10 is operated by the performer's mouth. The sound system 7 includes speakers or the like and outputs musical notes.

As illustrated in the partial through-view of the electronic wind instrument 100 in FIG. 1A, a breath pressure detector 2, a central processing unit (CPU) 3 that functions as a controller, a read-only memory (ROM) 4, a random-access memory (RAM) 5, and a sound source 6 are arranged on a substrate 17 arranged inside the body 100*a*. The substrate 17 includes wires that function as a bus 8 and connect together the breath pressure detector 2, the CPU 3, the ROM 4, the RAM 5, and the sound source 6.

The breath pressure detector 2 detects the pressure of the stream of air blown into the mouthpiece 10 by the performer. The sound source 6 is a circuit that generates musical notes.

Figure 2:
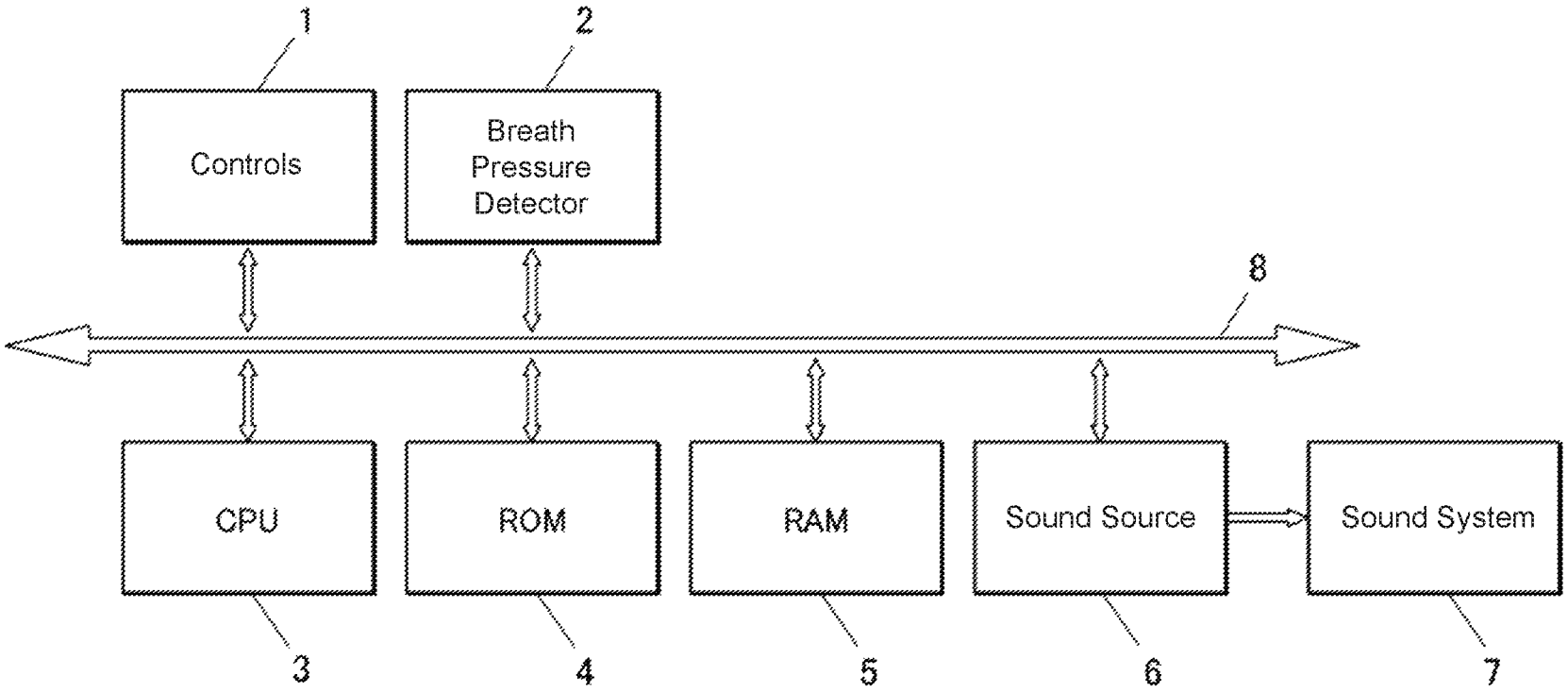
FIG. 2 is a block diagram illustrating a system configuration of the electronic wind instrument according to Embodiment 1.

Next, the features and configuration of the electronic wind instrument 100 will be described with reference to FIG. 2. FIG. 2 is a block diagram illustrating the system configuration of the electronic wind instrument 100.

As illustrated in FIG. 2, the electronic wind instrument 100 includes the controls 1, the breath pressure detector 2, the CPU 3 that functions as a controller, the ROM 4, the RAM 5, the sound source 6, and the sound system 7. All of the components of the electronic wind instrument 100 other than the sound system 7 are connected together by the bus 8.

The controls 1, which include the performance keys, the settings keys, and the like receive key operations from the performer, and the resulting operation data is output to the CPU 3. The settings keys can be used to set the type of wind instrument to emulate, change the pitch according to the key of a song, and fine-tune the pitch. The breath pressure detector 2 detects the pressure of the stream of air blown into the mouthpiece 10 by the performer and outputs the resulting pressure data to the CPU 3.

The CPU 3 controls the components of the electronic wind instrument 100. The CPU 3 loads a specified program from the ROM 4 and runs it using the RAM 5. The CPU 3 uses the running program to execute various processes. More specifically, the CPU 3 sends musical note generation instructions to the sound source 6 according to the operation data from the controls 1 and the pressure data from the breath pressure detector 2.

The ROM 4 is a read-only semiconductor memory and stores various types of data and programs. The RAM 5 is a volatile semiconductor memory and has a working area that temporarily stores data and programs.

The sound source 6 is a synthesizer that generates musical notes according to musical note generation instructions generated by the CPU 3 on the basis of the operation data from the controls 1 and then outputs the resulting musical note signals to the sound system 7. The sound system 7 amplifies the musical note signals from the sound source 6 and outputs the resulting signals as musical notes from a built-in speaker.

Figure 3A:
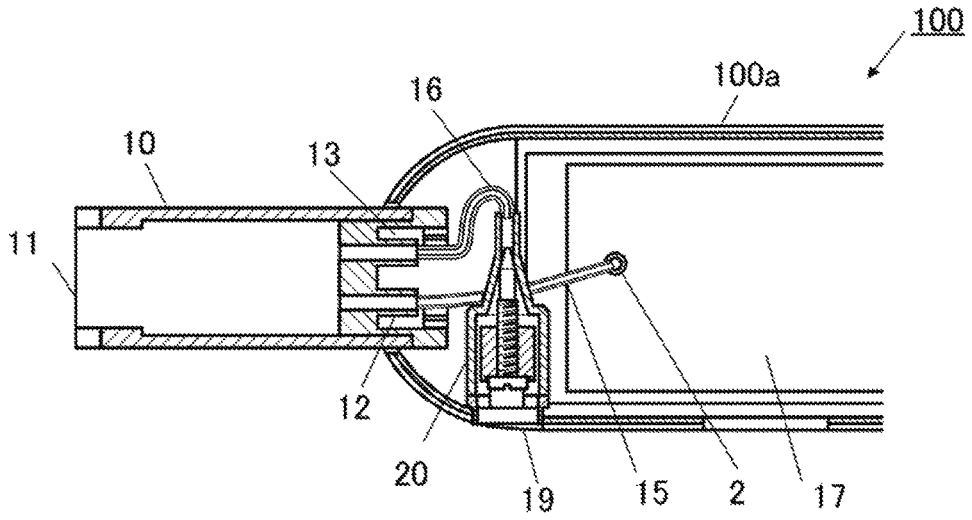
FIG. 3A is a horizontal cross-sectional view illustrating a drain structure of the electronic wind instrument according to Embodiment 1.
Figure 3B:
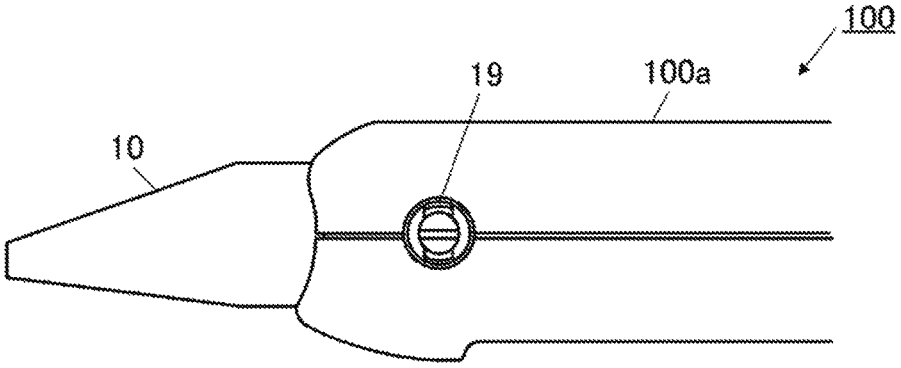
FIG. 3B is a side view of the electronic wind instrument according to Embodiment 1.

Next, the structure of a drain of the electronic wind instrument 100 will be described with reference to FIGS. 3A and 3B. FIG. 3A is a cross-sectional view of the drain structure of the electronic wind instrument 100. FIG. 3B is a side view of the electronic wind instrument 100.

As illustrated in FIG. 3A, the mouthpiece 10 includes an opening 11 onto which the performer's mouth fits and two openings 12 and 13 on the body 100*a* side. The electronic wind instrument 100 also includes tubes 15 and 16, the substrate 17, and a drain unit 20 that functions as an adjustment unit, which are arranged inside the body 100*a*. As illustrated in FIG. 3B, the electronic wind instrument 100 includes on one side face thereof an outlet 19 that functions as part of the drain unit 20.

The breath pressure detector 2 is mounted on the substrate 17. The breath pressure detector 2 is connected to the opening 12 via the tube 15. The drain unit 20 is connected to the opening 13 via the tube 16. The breath pressure detector 2 does not include a structure for exhausting air blown thereinto. The drain unit 20, however, exhausts air blown into the opening 11 by the performer through the outlet 19.

Figure 4A:
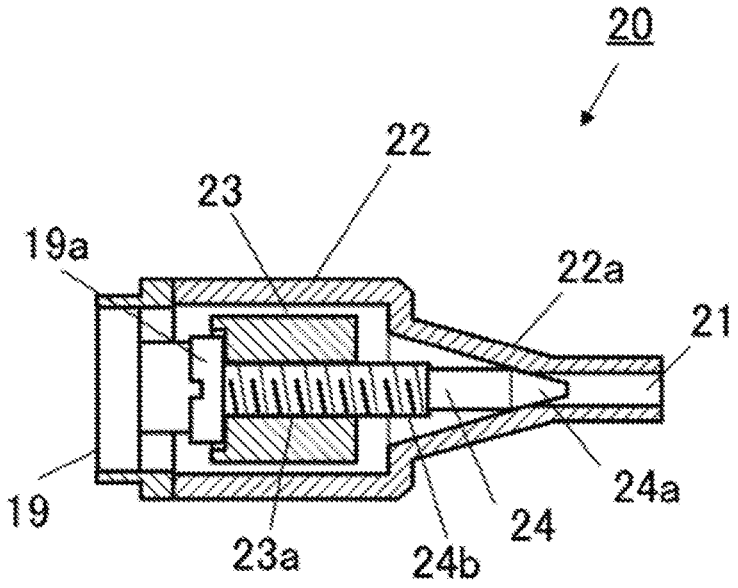
FIG. 4A is a cross-sectional view of a first drain unit in a closed state.
Figure 4B:
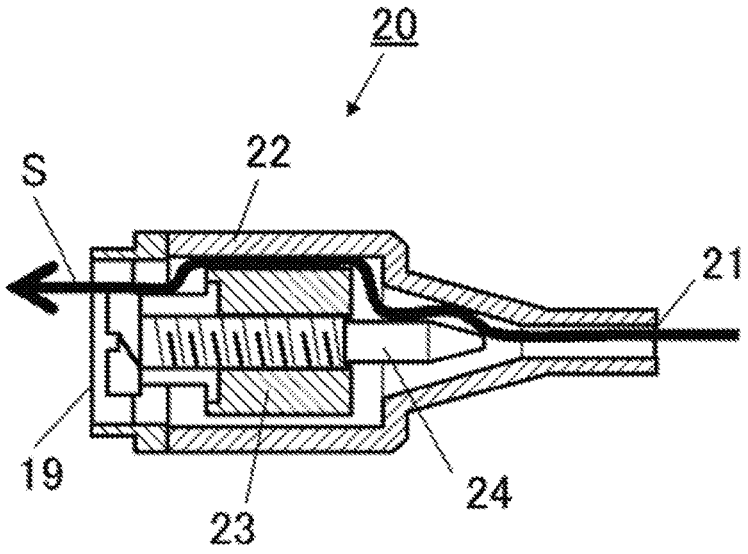
FIG. 4B is a cross-sectional view of the first drain unit in an open state.

Next, the structure of the drain unit 20 will be described with reference to FIGS. 4A and 4B. FIG. 4A is a vertical cross-sectional view of the drain unit 20 in a closed state. FIG. 4B is a vertical cross-sectional view of the drain unit 20 in an open state.

As illustrated in FIG. 4A, the drain unit 20 includes a case 22 in which an inlet 21 and the outlet 19 are formed, a first retaining member 23, a shaft-shaped adjustment member 24 that can move freely inside the case 22 and adjusts the aperture of a path S, and a screw head 19*a*. The case 22 includes a hollow cylinder portion and a tapered portion 22*a* connected to the inlet side of the hollow cylinder portion. The inlet 21 is also hollow cylinder-shaped and is connected to the end of the tapered portion 22*a*. In other words, the interior of the case 22 is a shaped like a pipe in which the inner diameter of the pipe decreases moving towards the side from which air is blown in. (Comment: This "pipe" is the portion of the case 22 that becomes narrower moving from the tapered portion 22*a* to the inlet 21, as illustrated in the figure.) The tube 16 is connected to the inlet 21. The outlet 19 of the drain unit 20 is arranged on the side of the hollow cylinder portion of the case 22 from which air is exhausted.

Inside the case 22, the adjustment member 24 is arranged running in the axial direction, and the first retaining member 23 surrounds and supports the adjustment member 24. The adjustment member 24 is a shaft on which male threads that function as a first screw portion are formed. The adjustment member 24 includes a tapered portion 24*a* on the inlet side and the screw head 19*a* that has a slot for a slotted screwdriver and functions as a setting member on the outlet side. The screw head 19*a* is not limited to being a screw head for a slotted screwdriver. The first retaining member 23 is fixed to the case 22, and female threads that function as a second screw portion and fit the male threads formed on the adjustment member 24 are formed in the first retaining member 23. Therefore, by rotating the screw head 19*a* of the adjustment member 24 using a slotted screwdriver inserted through the outlet 19, the adjustment member 24 can be moved in the axial direction thereof (left and right in the figure) due to the threading between the female threads of the first retaining member 23 and the male threads of the adjustment member 24. This movement makes it possible to expand or constrict the flow path from the inlet 21 to the tapered portion 22*a*, thereby making it possible to adjust the amount of air that can flow through the path S. Thus, the conductance of air is adjustable by expanding or constricting the flow path from the inlet 21 to the tapered portion 22*a*. Note that the first screw portion and the second screw portion may be switched.

FIG. 4A illustrates the closed state of the drain unit 20, in which the adjustment member 24 is moved as far as possible to the right side of the figure (that is, towards the inlet 21) such that the tapered portions 22*a* and 24*a* are in contact with one another. Here, the adjustment member 24 contacts the inner walls of the case 22 from the inlet 21 to the tapered portion 22*a* with no gaps therebetween, thereby completely sealing shut the path S. FIG. 4B illustrates the open state of the drain unit 20, in which the adjustment member 24 is moved towards the left side in the figure (that is, towards the outlet 19). This results in a gap between the adjustment member 24 and the inner walls of the case 22, thereby opening the path S. When the drain unit 20 is in the open state, air that enters through the inlet 21 proceeds along the path S and then exits through the outlet 19. As the drain unit 20 is adjusted from the closed state to a completely open state by moving the adjustment member 24 from the inlet 21 side to the outlet 19 side, the amount of air that can flow through the drain unit 20 gradually increases.

Figure 5:
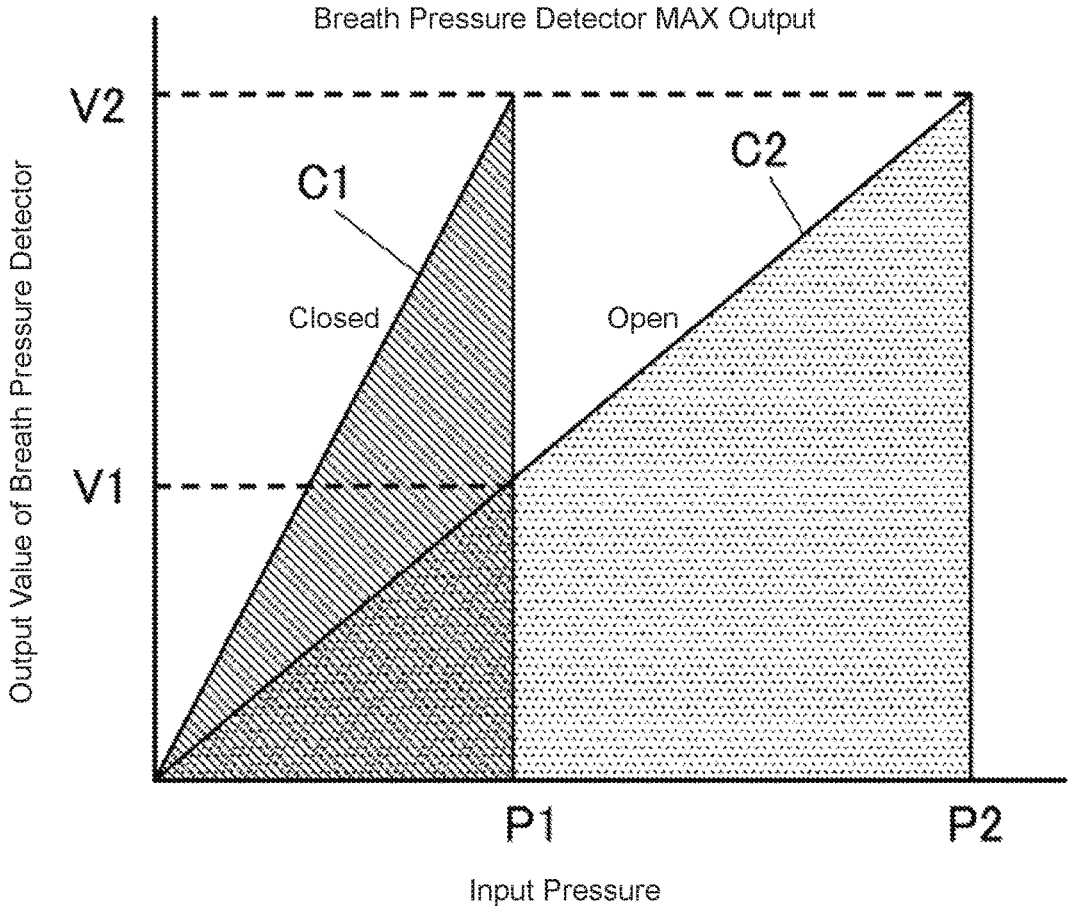
FIG. 5 is a graph showing the output from a breath pressure detector as a function of the pressure of the air blown into the electronic wind instrument according to the Embodiment 1 by a performer.

Next, the present embodiment and a comparative example will be described. FIG. 5 is a graph showing the output from the breath pressure detector 2 as a function of the pressure of the air blown into the electronic wind instrument 100 by the performer. FIG. 11 is a graph showing the output from a breath pressure detector 2C as a function of the pressure of the air blown into an electronic wind instrument 200 according to a comparative example as illustrated in FIG. 10 by the performer.

Figure 10:
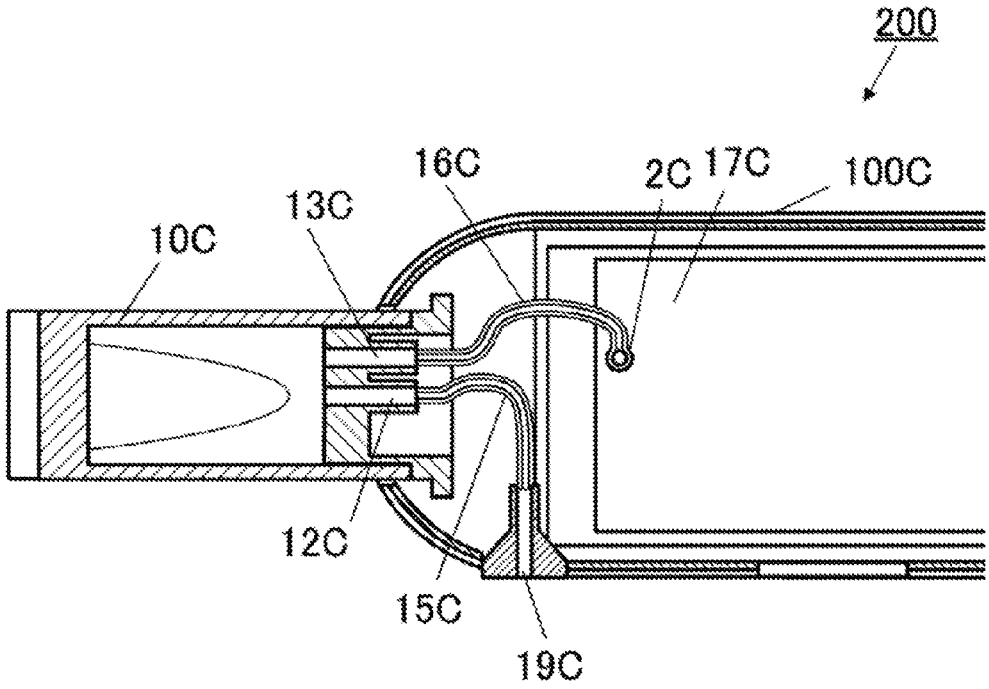
FIG. 10 is a cross-sectional view of an electronic wind instrument according to a comparative example.
Figure 11:
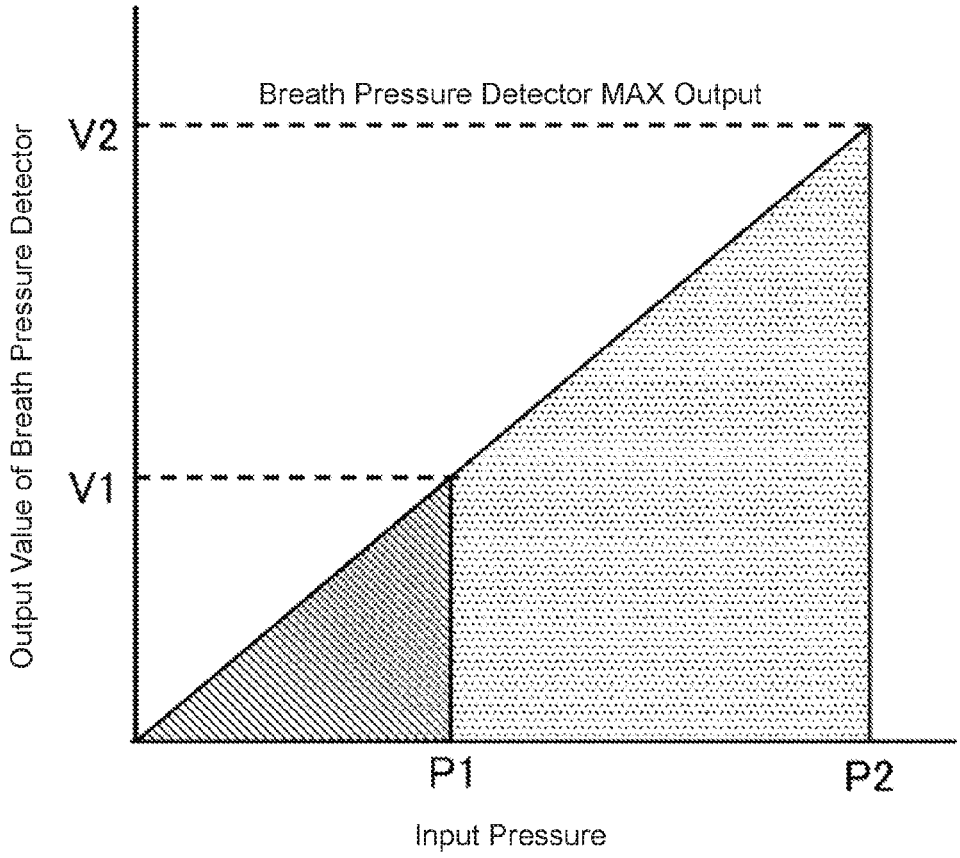
FIG. 11 is a graph showing the output from a breath pressure detector as a function of the pressure of the air blown into the electronic wind instrument according to the comparative example by a performer.

As illustrated in FIG. 10, the electronic wind instrument 200 includes a breath pressure detector 2C mounted on a substrate 17C arranged inside a body 100C. A mouthpiece 10C includes an opening 13C, and the breath pressure detector 2C is connected to the opening 13C by a tube 16C. Air blown into the mouthpiece 10C is exhausted via an outlet 19C, which is connected to a drain opening 12C via a tube 15C.

In this way, air blown into the electronic wind instrument 200 by the performer is divided between a path that leads to the breath pressure detector 2C (a sensor path) and a path that leads to outside of the instrument (a drain path).

As illustrated in FIG. 11, there is a substantially linear relationship between the pressure of the air blown by the performer and the resulting output of the breath pressure detector 2C. This is because the flow area is substantially constant along the length of the tube 15C. Each performer is capable of producing a different input pressure. If the breath pressure detector 2C is tuned to output a maximum output value V2 when a maximum predicted input pressure P2 is blown into the instrument, performers that can only produce an input pressure P1 will not be able to achieve a volume any louder than the volume corresponding to the resulting output value V1 of the breath pressure detector 2C.

When creating musical note generation instructions for the sound source 6, the CPU 3 increases the volume of the musical notes as the pressure data from the breath pressure detector 2 increases. In at least one aspect of the present invention, the screw head 19*a* is rotated to adjust the position of the adjustment member 24 such that the drain unit 20 is in a sufficiently open state or a fully open state. As illustrated in FIG. 5, P1 is the maximum possible input pressure that can be produced by a first performer, and P2 is the maximum possible input pressure that can be produced by a second performer. Furthermore, V2 is the output value of the breath pressure detector 2 corresponding to the maximum volume at which the electronic wind instrument 100 can output musical notes.

As shown by line C2 in FIG. 5, when the second performer blows air into the mouthpiece 10, by changing the input pressure from the ambient pressure to P2, the second performer can achieve output values ranging from 0 to V2 from the breath pressure detector 2. This makes it possible to cover the full range of musical note volumes from 0 to the maximum volume.

However, if the drain unit 20 is kept in the same open state that produces the line C2 as described above, because the first performer can only produce input pressures up to P1, the first performer will only be able to achieve output values up to V1 (<V2) from the breath pressure detector 2. Therefore, the first performer will not be able to play musical notes at the maximum volume. This is the same problem with the control scheme of the electronic wind instrument 200 illustrated in FIG. 10.

Here, however, the screw head 19*a* can be rotated to move the adjustment member 24 towards the inlet 21 side, thereby partially closing the valve and adjusting the drain unit 20 into a more closed state. As shown by line C1 in FIG. 5, this makes it possible to achieve output values from 0 to V2 from the breath pressure detector 2 by changing the pressure of the air blown into the instrument from the ambient pressure to P1, thereby making it possible to cover the full range of musical note volumes from 0 to the maximum volume even with smaller input pressures.

In the electronic wind instrument 100 according to the present embodiment, the volume of the musical notes does not depend only on the absolute pressure of the air blown into the instrument by the performer and can be adjusted according to the state of the drain unit 20. Therefore, musical notes can be output at the maximum volume configured for the electronic wind instrument 100 even if the input pressure produced by the performer is relatively low.

Furthermore, the drain unit 20 includes the case 22 that forms a flow path for the air, the adjustment member 24 that is arranged inside the case 22 and adjusts the aperture of the flow path according to the distance between the adjustment member 24 and the case 22, the first retaining member 23 that supports the adjustment member 24 and moves the adjustment member 24 according to the rotation setting, and the screw head 19*a* for adjusting the position of the adjustment member 24 inside the case 22. The screw head 19*a* is set to a rotation setting that positions the adjustment member 24 appropriately for the maximum input pressure that can be produced by the performer. This makes it possible to use a simple structure to implement the adjustment unit for adjusting the flow rate of the exhaust air.

Furthermore, the adjustment member 24 has male threads, and the first retaining member 23 has female threads that fit the male threads. The screw head 19*a* is formed on the adjustment member 24 and can be rotated to move the adjustment member 24. This makes it possible to easily use a screwdriver to rotate the screw head 19*a* to a rotation setting appropriate for the maximum input pressure that can be produced by the performer.

Embodiment 2

Figure 6A:
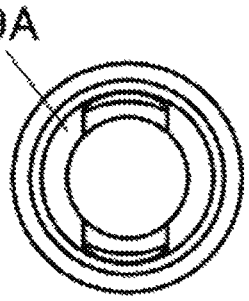
FIG. 6A illustrates an outlet of a second drain unit.
Figure 6B:
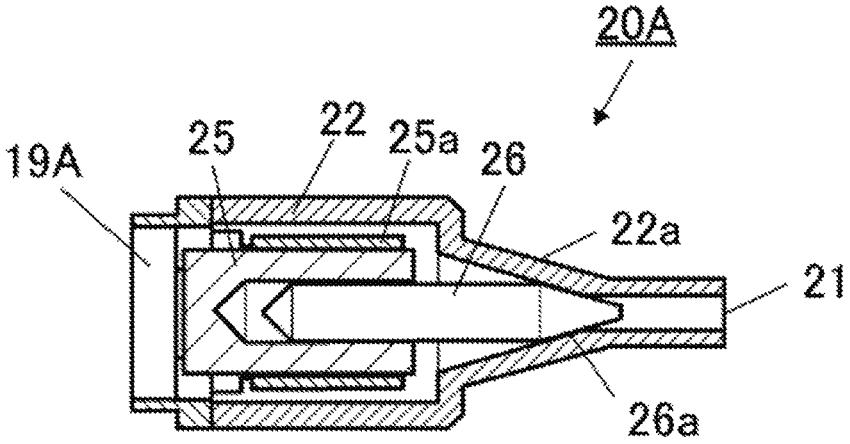
FIG. 6B is a cross-sectional view of the second drain unit in a fully closed state.
Figure 6C:
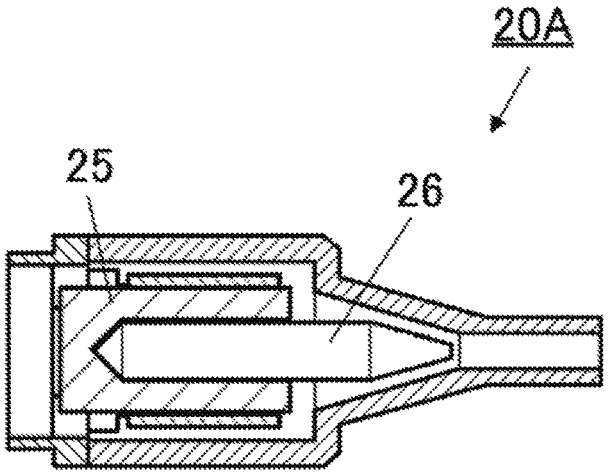
FIG. 6C is a cross-sectional view of the second drain unit in a fully open state.

Next, Embodiment 2 of the present invention will be described with reference to FIGS. 6A to 6C and FIG. 7. FIG. 6A illustrates an outlet 19A of a drain unit 20A. FIG. 6B is a cross-sectional view of the drain unit 20A in a fully closed state. FIG. 6C is a cross-sectional view of the drain unit 20A in a fully open state.

In the present embodiment, the electronic wind instrument 100 according to Embodiment 1 is used, but the drain unit 20 is replaced with the drain unit 20A. Furthermore, the controls 1 include a setting key (a setting unit) that allows the performer to input a duty cycle DUTY (described in more detail later). Note also that the same reference characters are used to indicate components that are the same as the components used in the electronic wind instrument 100 according to Embodiment 1, and descriptions of those components will be omitted here.

As illustrated in FIG. 6B, the drain unit 20A functions as an adjustment unit and includes a case 22, a frame 25, a plunger 26, and an outlet 19A. The outlet 19A of the drain unit 20A is arranged on the side of a hollow cylinder portion of the case 22 from which air is exhausted. As illustrated in FIG. 6A, the drain unit 20A does not include a manually adjustable component such as a screw head.

Inside the case 22, the plunger 26 is arranged running in the axial direction, and the frame 25 of a solenoid that functions as a plunger moving member surrounds the plunger 26. The plunger 26 is a solenoid plunger and includes a tapered portion 26*a* on the inlet side thereof that functions as a constricting portion. The frame 25 is fixed to the case 22 and includes a solenoid coil 25*a*. The frame 25 can move the plunger 26 in the axial direction thereof (left and right in the figure) according to whether a current is flowing through the solenoid coil 25*a*. In other words, when no current is flowing to the frame 25, the plunger 26 is pushed out to the right by an energizing member (not illustrated in the figure) of the frame 25 and functions as a valve (corresponding to the closed valve state). When current is flowing to the frame 25, the plunger retracts into the frame 25 (corresponding to the open valve state). The CPU 3 uses pulse width modulation (PWM) to control the current to the frame 25. Therefore, the drain unit 20A is also connected to the bus 8 illustrated in FIG. 2.

In this way, the plunger 26 moves to adjust the path that air that enters through the inlet 21 follows before exiting through the outlet 19A. Moving the plunger 26 makes it possible to adjust (that is, expand or constrict) this path. FIGS. 6B and 6C are cross-sectional views taken vertically through the case 22 with the case 22 arranged with the inlet 21 on the right side and the outlet 19A on the left side. As illustrated in FIGS. 6B and 6C, the more the plunger 26 is moved towards the inlet 21 side, the narrower the area the path inside of the case 22 becomes. Conversely, the more the plunger 26 is moved towards the outlet 19A side, the wider the area of the path inside of the case 22 becomes.

FIG. 6B illustrates the fully closed state of the drain unit 20A, in which no current flows to the frame 25 and the plunger 26 is moved as far as possible towards the inlet 21 side such that the tapered portions 22*a* and 26*a* are in contact with one another. FIG. 6C illustrates the fully open state of the drain unit 20A, in which current does flow to the frame 25 and the plunger 26 is moved as far as possible towards the outlet 19A side. When the drain unit 20A is in the fully open state, air that enters through the inlet 21 proceeds along the path inside the case 22 and then exits through the outlet 19A. The plunger 26 moves left and right between these states, and as the amount of time the plunger 26 spends in the fully open state relative to the total cycle period increases (that is, as the duty cycle DUTY increases), the flow rate of air through the drain unit 20A increases.

Figure 7:
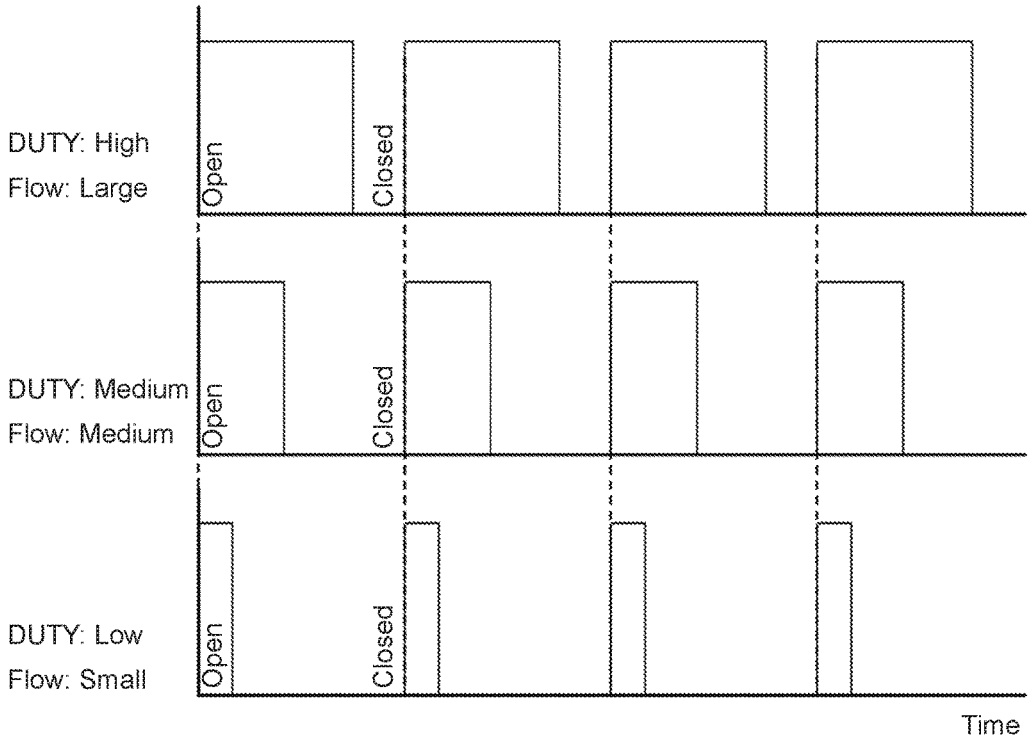
FIG. 7 includes graphs of current control patterns as a function of time for three different duty cycles DUTY: high, mid, and low.

Next, control of musical notes according to the input pressure will be described with reference to FIG. 7. FIG. 7 includes graphs of current control patterns as a function of time for three different duty cycles DUTY: high, mid, and low.

When creating musical note generation instructions for the sound source 6, the CPU 3 increases the volume of the musical notes as the pressure data from the breath pressure detector 2 increases and also controls the PWM signal sent to the drain unit 20A according to the duty cycle DUTY input using the controls 1.

Next, consider a third, fourth, and fifth performer, each capable of producing a higher maximum input pressure than the last. The fifth performer produces the highest maximum input pressure, and therefore this performer will be able to produce musical notes at the maximum volume even if the ratio of the amount of time the drain unit 20A spends in the fully open state is relatively high. For performers who, like the fifth performer, can produce a sufficiently high maximum input pressure, the duty cycle DUTY is set to high using the controls 1. In this case, the CPU 3 detects from the operation data from the controls 1 that the duty cycle DUTY was set to high and generates a PWM signal that controls the current flowing to the frame 25 of the drain unit 20A such that the high duty cycle DUTY shown in FIG. 7 is achieved. In the high duty cycle DUTY, the ratio of time that the drain unit 20A spends in the fully open state relative to the total cycle period is high, thereby making it possible for a large amount of air to flow through the drain unit 20A. Performers capable of producing the same maximum input pressure as the fifth performer can change the input pressure blown into the instrument to change the output values from the breath pressure detector 2, thereby making it possible to cover the full range of musical note volumes from 0 to the maximum volume when playing the electronic wind instrument 100 that includes the drain unit 20A.

For performers who, like the fourth performer, are capable of producing a medium maximum input pressure, the duty cycle DUTY is set to mid using the controls 1. In this case, the CPU 3 detects from the operation data from the controls 1 that the duty cycle DUTY was set to mid and generates a PWM signal that controls the current flowing to the frame 25 of the drain unit 20A such that the mid duty cycle DUTY (which is shorter than the high duty cycle) shown in FIG. 7 is achieved. In the mid duty cycle DUTY, the ratio of time that the drain unit 20A spends in the fully open state relative to the total cycle period is of a medium magnitude (and lower than in the high duty cycle), thereby making it possible for a medium amount of air to flow through the drain unit 20A. Performers capable of producing the same maximum input pressure as the fourth performer can change the input pressure blown into the instrument to change the output values from the breath pressure detector 2, thereby making it possible to cover the full range of musical note volumes from 0 to the maximum volume when playing the electronic wind instrument 100 that includes the drain unit 20A.

For performers who, like the third performer, are capable of producing a low maximum input pressure, the duty cycle DUTY is set to low using the controls 1. In this case, the CPU 3 detects from the operation data from the controls 1 that the duty cycle DUTY was set to low and generates a PWM signal that controls the current flowing to the frame 25 of the drain unit 20A such that the low duty cycle DUTY (which is shorter than the mid duty cycle) shown in FIG. 7 is achieved. In the low duty cycle DUTY, the ratio of time that the drain unit 20A spends in the fully open state relative to the total cycle period is low (lower than in the mid duty cycle), thereby only allowing a small amount of air (less than in the mid duty cycle) to flow through the drain unit 20A. Performers capable of producing the same maximum input pressure as the third performer can change the input pressure blown into the instrument to change the output values from the breath pressure detector 2, thereby making it possible to cover the full range of musical note volumes from 0 to the maximum volume when playing the electronic wind instrument 100 that includes the drain unit 20A.

As described above, in the present embodiment the drain unit 20A includes the case 22 that forms a flow path for the air, the plunger 26 that is arranged inside the case 22 and adjusts the flow path according to the distance between the plunger 26 and the case 22, and the frame 25 to which current is supplied to move the plunger 26. This makes it possible to easily use the controls 1 to set a duty cycle DUTY appropriate for the maximum input pressure that can be produced by the performer and also makes it possible to use a simple structure to implement the adjustment unit for adjusting the flow rate of the exhaust air.

Furthermore, the CPU 3 generates a PWM signal that controls the current flowing to the frame 25 according to the maximum input pressure setting configured for the performer. This makes it possible to reduce power loss resulting from moving unnecessary current to the frame 25. Moreover, in the present embodiment the PWM control signal has two values: on and off. However, the present embodiment is not limited to this example, and the PWM control signal may include three or more values corresponding to intermediate states of openness of the drain unit 20A in addition to the fully closed and fully open states. Furthermore, when using a multivalued PWM control signal that include two or more values, the most closed state of the drain unit 20A represented by the values does not necessarily have to be a fully closed state.

Embodiment 3

Figure 8A:
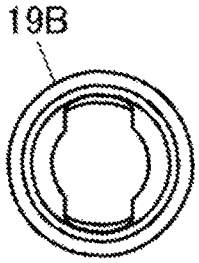
FIG. 8A illustrates an outlet of a third drain unit.
Figure 8B:
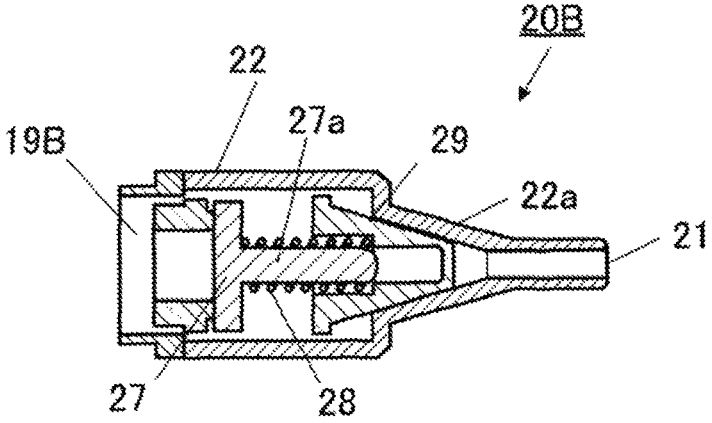
FIG. 8B is a cross-sectional view of the third drain unit in a fully closed state.
Figure 8C:
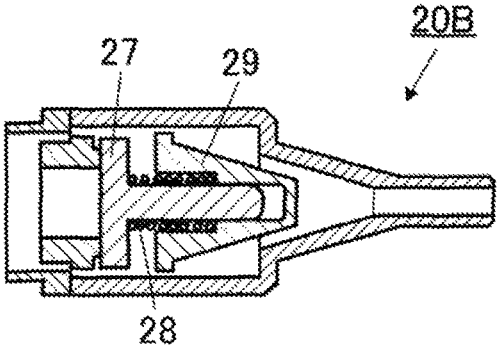
FIG. 8C is a cross-sectional view of the third drain unit in a fully open state.

Next, Embodiment 3 of the present invention will be described with reference to FIGS. 8A to 8C and FIG. 9. FIG. 8A illustrates an outlet 19B of a drain unit 20B. FIG. 8B is a cross-sectional view of the drain unit 20B in a fully closed state. FIG. 8C is a cross-sectional view of the drain unit 20C in a fully open state.

In the present embodiment, the electronic wind instrument 100 according to Embodiment 1 is used, but the drain unit 20 is replaced with the drain unit 20B. Note also that the same reference characters are used to indicate components that are the same as the components used in the electronic wind instrument 100 according to Embodiment 1, and descriptions of those components will be omitted here.

As illustrated in FIG. 8B, the drain unit 20B functions as an adjustment unit and includes a case 22, a fixed guide 27 that functions as a support, a spring 28 that functions as an energizing member, a movable valve 29 that functions as an adjustment member, and an outlet 19B. The outlet 19B of the drain unit 20B is arranged on the side of a hollow cylinder portion of the case 22 from which air is exhausted. As illustrated in FIG. 8A, the outlet 19B does not include a component such as a screw head that the performer can adjust manually.

Inside the case 22, the fixed guide 27 is arranged running in the axial direction and is fixed to the case 22. The fixed guide 27 includes a second support 27*a*, and the spring 28 is arranged surrounding the second support 27*a*. The movable valve 29 is arranged on the inlet-side end of the second support 27*a* of the fixed guide 27. The movable valve 29 can move in the axial direction and has a tapered shape. The movable valve 29 can be moved in the axial direction (left and right in the figure) according to the pressure of the air blown into the instrument.

FIG. 8B illustrates the drain unit 20B with the path S in a fully closed state, in which the input pressure is the ambient pressure (that is, the performer is not blowing air into the electronic wind instrument 100) and the energy stored in the spring 28 moves the movable valve 29 into contact with the tapered portion 22*a*. FIG. 8C illustrates the drain unit 20B in an open state, in which the performer is blowing air into the electronic wind instrument 100, thereby opposing the energy stored in the spring 28 and moving the movable valve more towards the inlet 21 side by an amount that corresponds to the input pressure. In the input pressure range from ambient pressure to PT, the spring 28 pushes the movable valve 29 away from the fixed guide 27 and towards the inlet side, thereby bringing the movable valve 29 into contact with the tapered portion 22*a* and putting the drain unit 20B in the fully closed state. Starting from this state, as the input pressure is increased, the movable valve 29 is pushed towards the fixed guide 27 and the air flow path (the aperture of the valve) widens, eventually bringing the drain unit 20B into the fully open state when the input pressure P4 is reached.

Figure 9:
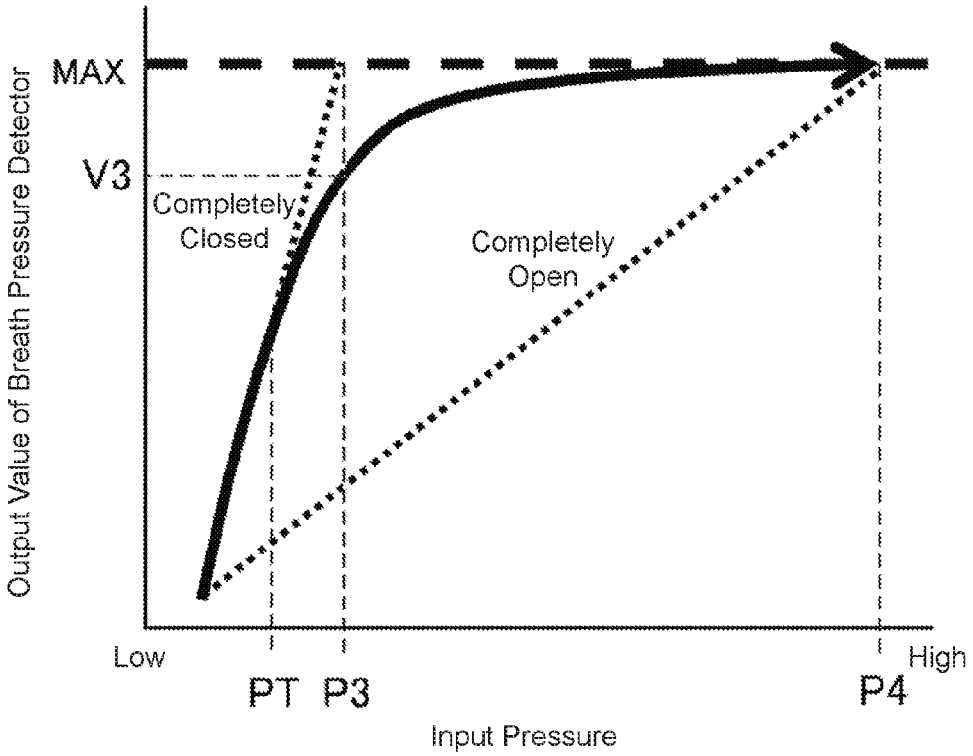
FIG. 9 is a graph showing the output from a breath pressure detector as a function of the pressure of the air blown into the electronic wind instrument according to the Embodiment 3 by a performer.

Next, control of musical notes according to the input pressure will be described with reference to FIG. 9. FIG. 9 is a graph showing the output from the breath pressure detector 2 as a function of the pressure of the air blown into the electronic wind instrument 100 according to the present embodiment by the performer.

When creating musical note generation instructions for the sound source 6, the CPU 3 increases the volume of the musical notes as the pressure data from the breath pressure detector 2 increases. As illustrated in FIG. 9, for input pressures from ambient pressure to PT, the force of the spring 28 is greater than or equal to the force created by the input pressure that attempts to move the movable valve 29 towards the outlet 19B side, and the drain unit 20B remains in the fully closed state. Therefore, the relationship between the input pressure produced by the performer and the output from the breath pressure detector 2 is substantially linear and exhibits the same slope as line C1 in FIG. 5. Once the input pressure exceeds PT, the force created by the input pressure that attempts to move the movable valve 29 towards the outlet 19B side becomes greater than the force of the spring 28, and therefore the movable valve 29 moves towards the outlet 19B side, opening a path S. As a result, in comparison to the input pressure region up to PT, the increase in the output of the breath pressure detector 2 for a given increase in the input pressure becomes smaller, as does the resulting increase in volume. Therefore, when the input pressure reaches P3, the output of the breath pressure detector 2 is V3, which is less than the maximum value MAX that would have been achieved at P3 if the drain unit 20B had remained in the fully closed state. As the input pressure increases from P3 to P4, the spring 28 continues to be compressed and resists further compression more strongly. Therefore, the increase in the aperture of the path S due to movement of the movable valve 29 as well as the increase in the output of the breath pressure detector 2 for a given increase in the input pressure becomes smaller, as does the resulting increase in volume. As a result, even at relatively high input pressures, the volume continues to increase according to increases in the output of the breath pressure detector 2 due to increases in the input pressure, thereby making it possible to better simulate the feeling of playing an acoustic wind instrument.

In this way, even a sixth performer who is only capable of producing a relatively low maximum input pressure (such as P3) can still easily play musical notes at a sufficiently loud volume corresponding to the output value V3, which is close to the maximum output MAX. Meanwhile, starting from the fully closed state of the drain unit 20B, a seventh performer who is capable of producing a high maximum input pressure (such as P4) can gradually increase the input pressure from 0 to play at a volume that follows the same slope as the line C1 in FIG. 5. Once the input pressure exceeds PT, the drain unit 20B starts to open and the slope of the volume curve begins to decrease. As the seventh performer continues to increase the input pressure, the output of the breath pressure detector 2 more gradually approaches the maximum value until the input pressure reaches P4, at which the maximum output from the breath pressure detector 2 is achieved. Therefore, by changing the input pressure blown into the instrument, the seventh performer can achieve output values ranging from 0 to the maximum value from the breath pressure detector 2, thereby making it possible to cover the full range of musical note volumes from 0 to the maximum volume.

In the present embodiment as described above, the electronic wind instrument 100 includes the breath pressure detector 2 that detects the pressure of air blown into the instrument, the CPU 3 that sets the volume of musical notes generated by the sound source 6 according to the detected input pressure, and the drain unit 20B that adjusts the flow rate of exhausted air such that the relationship between the input pressure and the output of the breath pressure detector 2 follows a concave down curve as the input pressure increases until the output of the breath pressure detector 2 reaches the maximum value. In this curve, the relationship between the input pressure and the output of the breath pressure detector 2 is linear while the air flow path is in the fully closed state. Therefore, even performers who can only produce relatively low input pressures can easily play musical notes at a sufficiently loud volume. This configuration also makes it possible to reduce the amount of work that the performer needs to do because no manual adjustments of a mechanical or electronic valve are required.

Furthermore, the drain unit 20B includes the case 22 that forms a flow path for the air, the movable valve 29 that is arranged inside the case 22 and adjusts the flow path according to the distance between the movable valve 29 and the case 22, the fixed guide 27 that supports the movable valve 29, and the spring 28 that pushes the movable valve 29 into contact with the case 22 when no air is blown into the instrument and resists movement of the movable valve 29 away from the case 22 according to the magnitude of the input pressure blown into the instrument. This makes it possible to use a simple structure to implement the adjustment unit for adjusting the flow rate of the exhaust air.

The embodiments described above are only examples of a suitable application of the present invention to an electronic wind instrument, and the present invention is not limited to these examples.

For example, in the embodiments described above, a single flow path through which air is exhausted is adjusted using a valve (and opening and closing the valve, for example) to adjust the flow rate of the air. However, the present invention is not limited to this example. A plurality of flow paths through which air is exhausted may be provided, and the overall air flow rate though the flow paths can be adjusted by opening and closing valves arranged in each flow path.

In the embodiments described above, the volume of musical notes generated by the sound source 6 is controlled according to the pressure of air blown into the instrument. However, the present invention is not limited to this example. In addition to controlling the volume, the pitch may be increased or the tone of the musical notes may be brightened as the input pressure increases, or alternatively, all three of the volume, pitch, and brightness of the tone of the musical notes may be increased as the input pressure increases.

Furthermore, the sound source 6 may be controlled to increase the pitch or brighten the tone of the musical notes without changing the volume as the input pressure increases, or alternatively, both the pitch and brightness of the tone of the musical notes may be increased without changing the volume as the input pressure increases.

Moreover, the lower-level aspects of the configuration and functions of the components of the electronic wind instrument 100 according to the embodiments described above may be modified as appropriate without departing from the spirit of the present invention.

Embodiments of the present invention were described above. However, the present invention is not limited to these embodiments, and any configurations included in the scope of the claims and their equivalents are also encompassed by the present invention.

Next, the present invention will be defined according to the claims first appended when the present application was filed. The claim numbers in the appended claims are the same claims numbers used in the claims first appended when the present application was filed.

It will be apparent to those skilled in the art that various modification and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. An electronic wind instrument, comprising:

a mouthpiece that receives breath blown into the mouthpiece and divides the breath into a first path and a second path that is distinct and different from the first path;

a breath pressure detector that receives the breath that has passed through the first path, that detects a breath pressure developed in the instrument by the breath that has passed through the first path, and that outputs a signal corresponding to the detected breath pressure;

an adjustment unit receiving the breath that has passed through the second path and providing an air exhaust passage to an exterior for the received breath that has passed through the second path, the air exhaust passage being configured to have a variable conductance for air so that a sensitivity of the breath pressure detector relative to an input pressure of the breath blown into the mouthpiece varies; and a controller that sets one or more among a tone, a volume, and a pitch of a sound to be generated by a sound source in accordance with the signal outputted from the breath pressure detector, wherein the adjustment unit includes:

a case that receives the breath that has passed through the second path, the case having a hollow portion and a tapered portion and forming a path for the received breath that has passed through the second path to flow through to the exterior, the tapered portion having a larger inner diameter portion and a smaller inner diameter portion; and an adjustment member that is movable relative to the tapered portion of the case between the larger inner diameter portion and the smaller inner diameter portion so as to expand or constrict the path for the received breath that has passed through the second path to flow through to the exterior, wherein the case has an inlet and an outlet, wherein the tapered portion is connected to an inlet side of the hollow portion, and wherein an interior of the tapered portion of the case is shaped like a pipe in which an inner diameter of the pipe decreases towards a side from which air is blown in.

2. The electronic wind instrument according to claim 1, wherein the adjustment unit further includes a retaining member that supports the adjustment member, wherein the adjustment member has a first screw portion, and wherein the retaining member has a second screw portion that fits the first screw portion.

3. The electronic wind instrument according to claim 1, wherein the conductance of the air exhaust passage of the adjustment unit is configured to be user adjustable so that once set, a relationship between the breath pressure detected by the breath pressure detector and the input pressure of the breath blown into the mouthpiece is fixed until a user changes the conductance of the air exhaust passage.

4. The electronic wind instrument according to claim 1, wherein the adjustment unit further includes a retaining member that supports the adjustment member, and wherein the hollow portion of the case has a shape of a cylinder.

5. The electronic wind instrument according to claim 1, wherein the adjustment member moves toward the larger inner diameter portion to expand the path, and moves toward the small inner diameter portion to constrict the path.

6. The electronic wind instrument according to claim 1, wherein the hollow portion of the case of the adjustment unit have a hollow generally cylindrical shape, and the adjustment member moves in a direction of a cylindrical axis of the case.

7. The electronic wind instrument according to claim 1, wherein the adjustment member has a tapered portion and the tapered portion of the adjustment member is movable into the tapered portion of the case.

8. The electronic wind instrument according to claim 7, wherein the tapered portion of the adjustment member has a larger diameter portion and a smaller diameter portion, and the larger diameter portion of the adjustment member is positioned nearer to the larger inner diameter portion of the tapered portion of the case and the smaller diameter portion of the adjustment member is positioned nearer to the smaller inner diameter portion of the tapered portion of the case.

9. An electronic wind instrument, comprising:

a mouthpiece that receives breath blown into the mouthpiece and divides the breath into a first path and a second path that is distinct and different from the first path;

a breath pressure detector that detects a breath pressure developed in the instrument by the breath that has passed through the first path and that outputs a signal corresponding to the detected breath pressure;

an adjustment unit receiving the breath that has passed through the second path and having a variable conductance for air for the received breath that has passed through the second path so that a sensitivity of the breath pressure detector relative to an input pressure of the breath blown into the mouthpiece varies; and a controller that sets one or more among a tone, a volume, and a pitch of a sound to be generated by a sound source in accordance with the signal outputted from the breath pressure detector, wherein the adjustment unit includes:

a case that receives the breath that has passed through the second path, the case having a hollow portion and a tapered portion and forming a path for the received breath that has passed through the second path to flow through, the tapered portion having a larger inner diameter portion and a smaller inner diameter portion; and an adjustment member that is movable relative to the tapered portion of the case between the larger inner diameter portion and the smaller inner diameter portion so as to expand or constrict the path for the received breath that has passed through the second path to flow through, wherein the case has an inlet and an outlet, wherein the tapered portion is connected to an inlet side of the hollow portion, and wherein an interior of the tapered portion of the case is shaped like a pipe in which an inner diameter of the pipe decreases towards a side from which air is blown in.

* * * * *